US011784014B2

(12) United States Patent
Mannekutla et al.

(10) Patent No.: US 11,784,014 B2
(45) Date of Patent: Oct. 10, 2023

(54) BREAKING DEVICE

(71) Applicant: ABB S.p.A., Milan (IT)

(72) Inventors: James Mannekutla, Västerås (SE); Zichi Zhang, Västerås (SE); Lars Jonsson, Västerås (SE); Julia Viertel, Västerås (SE); Alessio Bergamini, Gazzaniga (IT)

(73) Assignee: ABB S.p.A., Milan (IT)

( * ) Notice: Subject to any disclaimer, the term of this patent is extended or adjusted under 35 U.S.C. 154(b) by 0 days.

(21) Appl. No.: 17/663,081

(22) Filed: May 12, 2022

(65) Prior Publication Data

US 2022/0384128 A1 Dec. 1, 2022

(30) Foreign Application Priority Data

May 25, 2021 (EP) ..... 21175695

(51) Int. Cl.
*H01H 33/06* (2006.01)
*H01H 33/56* (2006.01)

(52) U.S. Cl.
CPC ..... *H01H 33/06* (2013.01); *H01H 33/56* (2013.01)

(58) Field of Classification Search
CPC ..... H01H 33/06; H01H 33/56; H01H 33/08; H01H 33/565; H01H 33/222; H01H 2003/225; H01H 3/28; H01H 9/342; H01H 9/32; H01H 9/36; H01H 9/10; H01H 9/121; H01H 9/285
USPC ... 218/114, 117, 110, 103, 79, 80, 99, 2, 12, 218/15, 34
See application file for complete search history.

(56) References Cited

U.S. PATENT DOCUMENTS 2,128,999 A * 9/1938 Frank ..... H01H 9/32 200/254
2,284,347 A 5/1942 Strom
3,281,561 A 10/1966 Marx et al.
(Continued)

FOREIGN PATENT DOCUMENTS

EP 3709325 A1 9/2020
GB 1201100 A 8/1970

OTHER PUBLICATIONS

Extended European Search Report; Application No. 21175695.2; Completed: Nov. 9, 2021; dated Nov. 23, 2021; 5 Pages.

*Primary Examiner* — William A Bolton
(74) *Attorney, Agent, or Firm* — WHITMYER IP GROUP LLC

(57) ABSTRACT

A breaking device for interrupting current includes an electrically conducting outer member, an electrically conducting inner member arranged radially inside the outer member with respect to a breaking axis and an electrically insulating or semiconducting breaking member arranged radially between the outer member and the inner member with respect to the breaking axis, where the breaking member is arranged to move along the breaking axis from a starting position to a protruding position in which the breaking member protrudes from a space within the outer member for interrupting a current between the outer member and the inner member and the breaking member includes an inner tubular element and an outer tubular element, where the outer tubular element is joined to an outer surface of the inner tubular element thereby defining a recess between the outer tubular element and the inner tubular element.

18 Claims, 7 Drawing Sheets

(56) References Cited

U.S. PATENT DOCUMENTS

| | | | | |
|---|---|---|---|---|
| 3,425,017 | A * | 1/1969 | Schockelt | H01H 3/30 337/17 |
| 3,586,802 | A * | 6/1971 | Nichols | H01H 33/77 218/90 |
| 3,984,651 | A | 10/1976 | Lewis et al. | |
| 4,692,577 | A * | 9/1987 | Swanson | H01H 39/006 218/117 |
| 6,518,865 | B1 * | 2/2003 | Al-Hosini | H01H 33/285 335/147 |
| 8,258,419 | B2 * | 9/2012 | Jeong | H01H 33/285 218/68 |
| 10,192,703 | B2 * | 1/2019 | Breder | H01H 39/004 |

* cited by examiner

BREAKING DEVICE

TECHNICAL FIELD

The present disclosure generally relates to breaking devices. In particular, a breaking device for interrupting current, is provided.

BACKGROUND

Breaking devices are important in a number of areas such as in power distribution systems.

EP 3709325 discloses one type of breaking device in the form a tubular breaking device comprising an electrically conducting inner member arranged radially inside an electrically conducting outer member as well as an electrically insulating or semiconducting breaking tube arranged radially between the outer member and the inner member. The breaking tube separates the electrically conducting members from each other as well as squeezes an arc that is caused to be generated by the separation of the electrically conducting members from each other.

This breaking device generally functions well. However, after some time the squeezing effect of an electrical arc is gradually reduced, due to material loss of elements within the device. This may lead to an increase of the arc interruption time. It is eventually possible that a breaking failure occurs.

There is therefore a need for an improved breaking device.

SUMMARY

One object of the present disclosure is to provide a breaking device for interrupting current, which breaking device is more resilient to wear and with lower material losses.

A further object of the present disclosure is to provide a breaking device for interrupting current, which breaking device provides a fast interruption of current.

A further object of the present disclosure is to provide a breaking device for interrupting current, which breaking device provides a reliable interruption of current.

A still further object of the present disclosure is to provide a breaking device for interrupting current, which breaking device can be used multiple times to interrupt current.

A still further object of the present disclosure is to provide a breaking device for interrupting current, which breaking device solves several or all of the foregoing objects in combination.

According to one aspect, there is provided a breaking device for interrupting current, the breaking device comprising:

an electrically conducting outer member;

an electrically conducting inner member arranged radially inside the outer member with respect to a breaking axis; and an electrically insulating or semiconducting breaking member arranged radially between the outer member and the inner member with respect to the breaking axis;

the breaking member being arranged to move along the breaking axis from a starting position to a protruding position in which the breaking member protrudes from a space within the outer member for interrupting a current between the outer member and the inner member by means of the breaking member; and the breaking member comprising an inner tubular element and an outer tubular element, where the outer tubular element is joined to an outer surface of the inner tubular element thereby defining a recess between the outer tubular element and the inner tubular element.

The recess may more particularly be defined between an inner surface of the outer tubular element and the outer surface of the inner tubular element.

The outer tubular element may be joined to the inner tubular element at a joining area of the outer surface of the inner tubular element. The joining area may more particularly be formed as cylinder-shaped part of the outer surface of the inner tubular element around the breaking axis.

The inner tubular element may additionally comprise a first protruding end and the outer tubular element may comprise a second protruding end.

The first protruding end may be placed in a first plane that this perpendicular to the breaking axis, the second protruding end may be placed in a second plane that is perpendicular to the breaking axis and a bottom of the recess may be located in a third plane that is also perpendicular to the breaking axis.

The inner tubular element may have a first protruding length, which may be a length between the first protruding end and the area where the outer tubular element is joined to the inner tubular element. The outer tubular element may in turn have a second protruding length that is the length between the second protruding end and the area where the outer tubular element is joined to the inner tubular element. Thereby the first protruding length of the inner tubular element may be the length of the inner tubular element along the breaking axis between the first plane and the third plane and the second protruding length of the outer tubular element may be the length of the outer tubular element along the breaking axis between the second plane and the third plane.

The second protruding end may be located between the first protruding end and the joining area in relation to the breaking axis.

The second protruding end may in one variation be substantially located midway between the joining area and the first protruding end in relation to the breaking axis. The second protruding end may thereby be substantially placed halfway between the first protruding end and the area where the outer tubular element is joined to the inner tubular element. Thereby the second plane with the second protruding end may be located essentially halfway between the first and the third planes. The distance between the second plane and the first plane may thereby also essentially be the same as the distance between the second plane and the third plane.

The second protruding end may in another variation be located closer to the joining area than to the first protruding end in relation to the breaking axis. Thereby the second plane with the second protruding end may be placed closer to the third plane than to the first plane. The distance between the second plane and the third plane may consequently be lower than the distance between the second plane and the first plane.

The second protruding end may in a further variation be located closer to the first protruding end than to the joining area in relation to the breaking axis. The second plane may thereby be located closer to the first plane with the first protruding end than to the third plane with the bottom of the recess. This also means that the distance between the second plane and the first plane may be lower than the distance between the second plane and the third plane.

The breaking device may further comprise an arcing chamber comprising an inner cavity for receiving the inner tubular element and an outer cavity for receiving the outer tubular element. The inner cavity may more particularly be shaped for receiving the first protruding length of the inner tubular element and the outer cavity may be shaped for receiving the second protruding length of the outer tubular element. The cavities may be cavities formed in a body of electrically insulating material, which may be a ceramic or a polymer body, where the polymer may be a thermoset or thermoplastic polymer, such as polyoxymethylene (POM), poly(methyl methacrylate) (PMMA), polyimide (PI), polyamide (PA) and/or a polyolefin, such as polypropylene (PP) or polymethylpentene (PMP) or another such polymer.

Through the existence of the inner and outer cavities, there is also formed a wall between them, which wall mates with the recess between the inner and outer tubular elements. A tip of the wall may more particularly be adapted to mate with the bottom of the recess.

It is furthermore possible that in the protruding position the first protruding end of the inner tubular element is arranged to abut the bottom of the inner cavity, the second protruding end of the outer tubular element is arranged to abut the bottom of the outer cavity and/or the bottom of the recess being arranged to abut the tip of the wall separating the inner cavity from the outer cavity.

The device may further comprise at least one vent opening for venting the arcing chamber when the breaking member has moved from the starting position, where each vent opening leads to one of the cavities. In this case it is possible that at least one first radial vent opening leads to the inner cavity. It is additionally or instead possible that at least one second radial vent opening leads to the outer cavity. Each radial vent opening may additionally lead to a cavity via a vent channel.

The outer member, the inner member, the inner tubular element and the outer tubular element may be substantially concentric with the breaking axis.

The breaking device may further comprise an actuator arranged to force the breaking member from the starting position to the protruding position.

The breaking device may additionally comprise a contact arrangement comprising a moveable contact element, which contact arrangement is configured to selectively electrically disconnect the outer member and the inner member. The contact arrangement may more particularly be configured to electrically disconnect the outer member and the inner member during movement of the breaking member from the starting position towards the protruding position.

The breaking member provides an electrical potential barrier between the outer member and the inner member. Due to the shape of the breaking member, the arc can be effectively trapped by movement of the breaking member from the starting position to the protruding position.

As the breaking member moves from the starting position, an arc path between the inner member and the outer member is lengthened. The breaking member may more particularly extend the length of the arc with a distance at least corresponding to a sum of twice the first protruding length and twice the second protruding length. Thereby, an arc voltage can be built up fast. The extended length of the arc path may eventually cause the arc to be extinguished. Thereby, a circuit comprising the breaking device can be opened. The starting position and the protruding position of the breaking member may thus correspond to a closed position and an open position, respectively, of the breaking device.

Since the breaking device comprises a breaking member with tubular elements, the breaking device constitutes a tubular breaker. The breaking device may be used for AC and DC applications, e.g. in low voltage and medium voltage ranges. The breaking device may be active or passive (i.e. not requiring auxiliary power other than from an applied circuit source). The breaking device according to the present disclosure may for example be implemented as a switching device, a power device, a commutation switch, a disconnector, a passive DC breaker, a passive AC breaker, a load switch or a current limiter.

The breaking member may further be arranged to move back along the breaking axis from the protruding position to the starting position. The breaking device may be configured to interrupt current multiple times.

The breaking member may be made of a ceramic and/or a polymer, where the polymer may be a thermoset or thermoplastic polymer, such as POM, PMMA, PI, PA, PP and/or PMP or another such polymer. It is additionally possible that the inner tubular element is formed of one insulating or semiconducting material and the outer tubular element is formed of another insulating or semiconducting material. The breaking member may be electrically insulating or semiconducting, but not electrically conducting.

The inner member may be connected to an inner electrical contact of an electrical circuit and the outer member may be connected to an outer electrical contact of the electrical circuit. The outer member and the inner member may be of various shapes, for example tubes, bars or rods. The outer member and the inner member may be of the same type of shape or of different types of shapes.

The outer member and/or the inner member may be an electrically conducting tube.

The outer member, the inner member and the breaking member may be substantially concentric, or concentric, with the breaking axis. In this case, a triaxial breaking device is formed.

The contact arrangement may be configured to electrically disconnect the outer member and the inner member during movement of the breaking member from the starting position towards the protruding position. The breaking member may push, or otherwise actuate, the moveable contact element of the contact arrangement when moving from the starting position towards the protruding position, to electrically disconnect the outer member and the inner member.

BRIEF DESCRIPTION OF THE DRAWINGS

Further details, advantages and aspects of the present disclosure will become apparent from the following embodiments taken in conjunction with the drawings, wherein.

DETAILED DESCRIPTION

Figure 1:
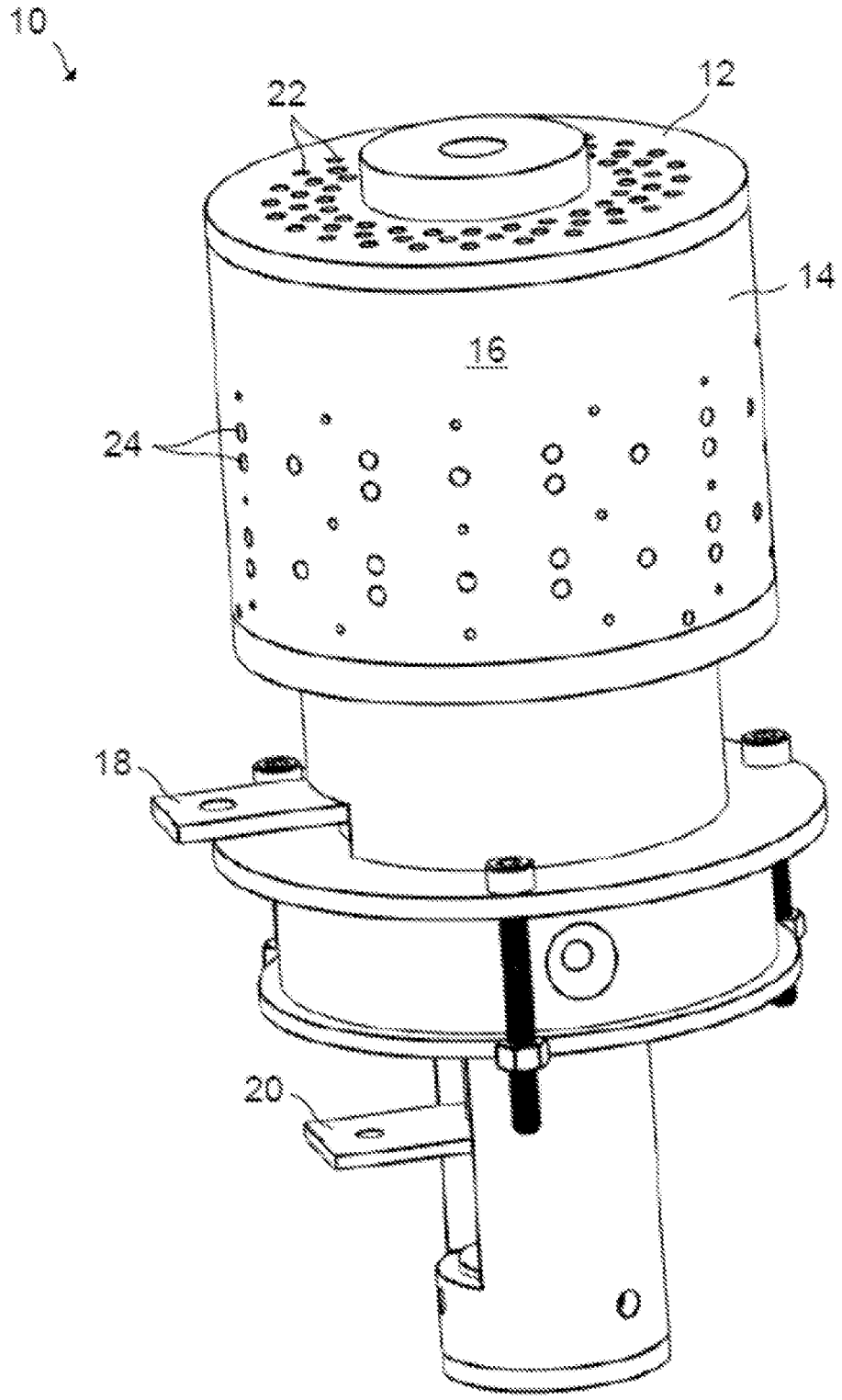
FIG. 1 schematically represents a perspective view of a breaking device.

In the following, a breaking device for interrupting current will be described. The same reference numerals will be used to denote the same or similar structural features.

FIG. 1 schematically represents a perspective view of a breaking device 10 configured to interrupt current. The breaking device 10 may be used for AC and DC applications, e.g. in low voltage and medium voltage ranges.

The breaking device 10 of this example comprises an end section 12 and a wall 14 providing a volume in which a breaking member receiving structure is arranged. The breaking member receiving structure is provided for receiving a breaking member and formed as a body of electrically insulating material. The end section 12, wall 14 and breaking member receiving structure together forms an arcing chamber 16. The breaking device 10 further comprises an outer electrical contact 18 and an inner electrical contact 20. A plurality of axial vent openings 22 are formed in the end section 12 and a plurality of radial vent openings 24 are formed in the wall 14. At least the breaking member receiving structure may for example be made of an electrically insulating material, which may be ceramic or a polymer, like a thermoset or thermoplastic polymer, such as polyoxymethylene (POM), poly(methyl methacrylate) (PMMA), polyimide (PI), polyamide (PA) and/or polyolefin, such as polypropylene (PP) or polymethylpentene (PMP) or another such polymer. It is additionally possible that also the end section 12 and the wall 14 are made of the same material.

Figure 2:
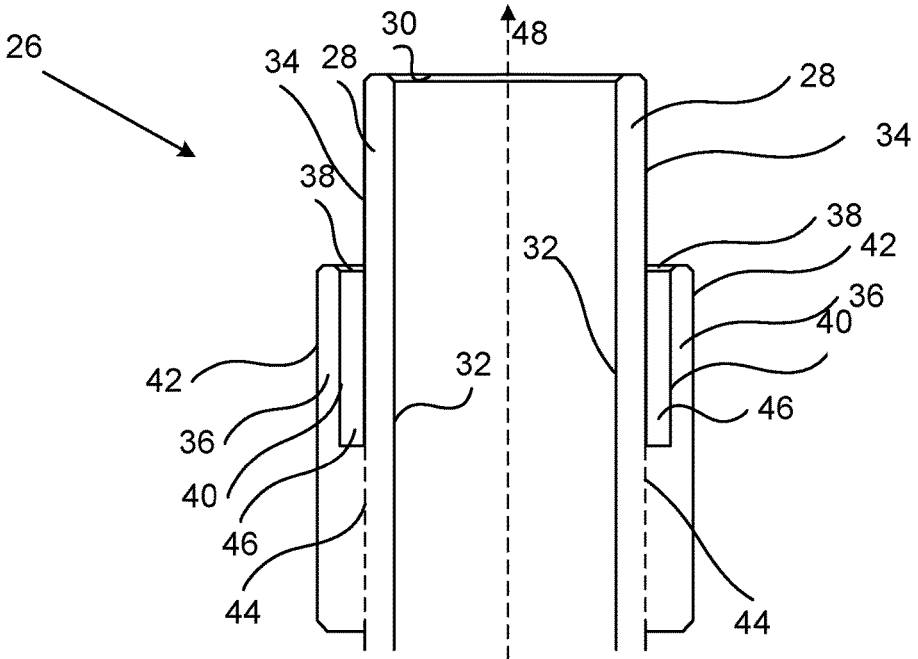
FIG. 2 schematically represents a cross-sectional side view of a breaking member of the breaking device.

FIG. 2 represents a cross-sectional side view of an electrically insulating or semiconducting breaking member 26 used in the breaking device 10. The breaking member 26 comprises an inner tubular element 28 and an outer tubular element 36. Both elements are thus formed as tubes and the inner tubular element 28 has an inner surface 32 and an outer surface 34 and the outer tubular element 36 has an inner surface 40 and an outer surface 42, where the inner surface is in the interior of the tubular element, while the outer surface is on the exterior of the tubular element. Both tubular elements are furthermore centered around a breaking axis 48. The intention is that the breaking member 26 and thereby also the tubular elements 28 and 36 are to move along the breaking axis 48 when performing a current interruption action.

The inner tubular element 28 comprises a first protruding end 30, which first protruding end 30 is placed in a first plane that this perpendicular to the breaking axis 48. The outer tubular element 36 comprises a second protruding end 38, which second protruding end 38 is placed in a second plane that is also perpendicular to the breaking axis 48.

The outer tubular element 36 is joined to the inner tubular element 28 at a joining area 44 of the outer surface 34 of the inner tubular element 28, where the joining area 44 may be formed as a cylinder-shaped part of the outer surface around the breaking axis 48. Thereby a recess 46 of circular shape is defined between the inner and outer tubular elements 36 and 28. The recess 46 is more particularly defined between the inner surface 40 of the outer tubular element 36 and the outer surface 34 of the inner tubular element 28.

The second protruding end 38 is located between the first protruding end 30 and the joining area 44 in relation to the breaking axis 48. The second plane with the second protruding end 38 is thereby placed along the breaking axis 48 between the first plane with the first protruding end 30 and a third plane in which a bottom of the recess 46 between the inner and outer tubular elements 28 and 36 is located. In the present example the second protruding end 38 is substantially placed halfway between the first protruding end 30 and the area where the outer tubular element 36 is joined to the inner tubular element 28, i.e. the second plane with the second protruding end is located halfway between the first and the third planes. The distance between the second plane and the first plane is thus essentially the same as the distance between the second plane and the third plane.

The inner tubular element 28 also has a first protruding length, which is a length between the first protruding end 30 and the joining area 44 where the outer tubular element 36 is joined to the inner tubular element 28 and the outer tubular element 36 has a second protruding length that is the length between the second protruding end 38 and the joining area 44 where the outer tubular element 36 is joined to the inner tubular element 28. Put differently the first protruding length of the inner tubular element 28 is the length along the breaking axis 48 between the first plane with the first protruding end 30 and the third plane with the bottom of the recess 46 and the second protruding length of the outer tubular element 36 is the length along the breaking axis 48 between the second plane with the second protruding end 38 and the third plane with the bottom of the recess 46.

The breaking member 26 can be made of either an insulating material, which may also be a ceramic or a polymer, like a thermoset or thermoplastic polymer, such as POM, PMMA, PI, PA, PP and/or PMP or another such polymer. Alternatively the breaking member may be made of a semiconducting material. It is also possible that the inner tubular element is made of one insulating or semiconducting material and that the outer tubular element is made of another insulating or semiconducting material. The inner tubular element 28 and the outer tubular element 36 of the breaking member 26 may additionally both have circular cross-sections. As can also be seen in FIG. 2, the breaking member 26 is concentric with the breaking axis 48.

Figure 3:
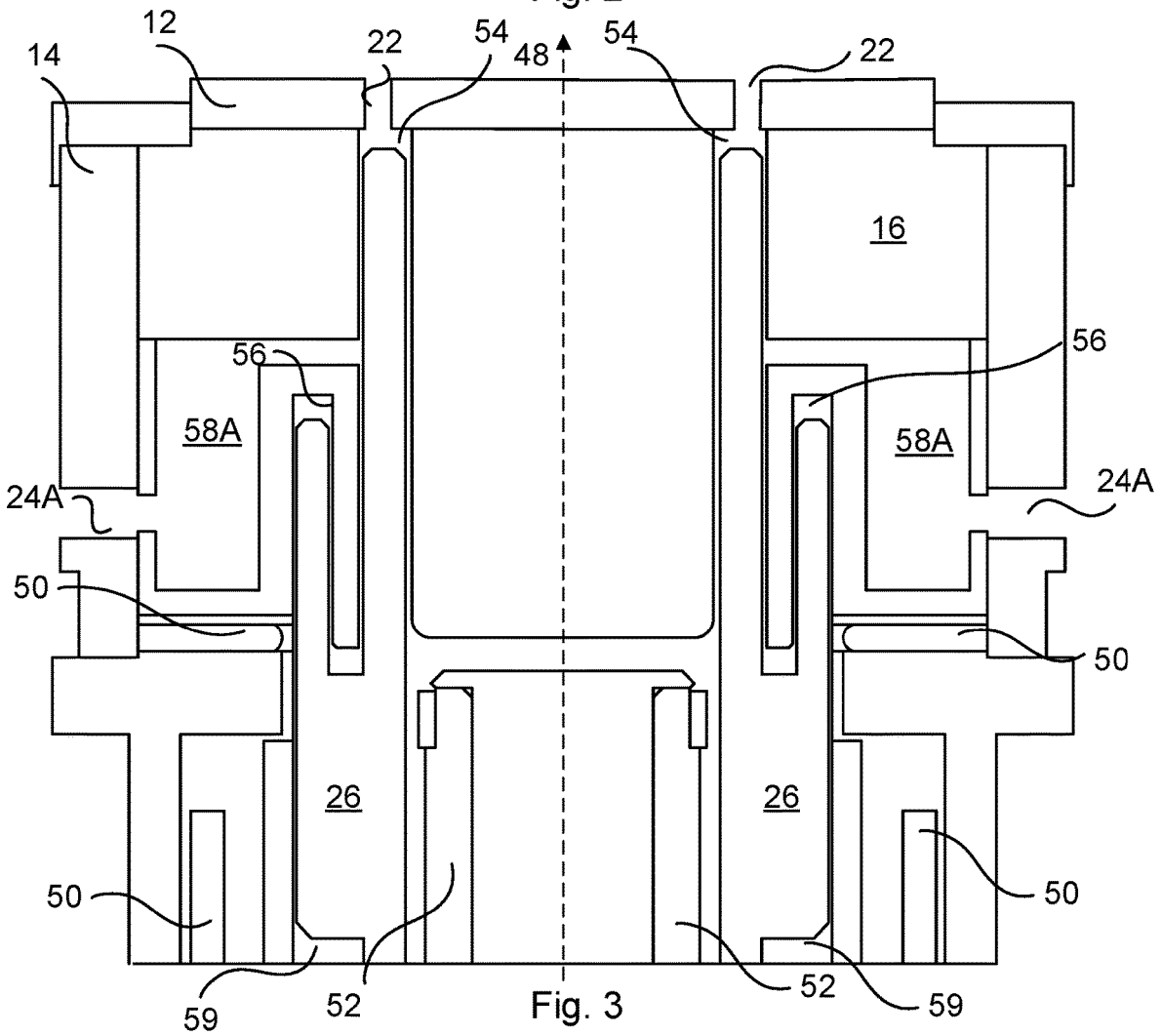
FIG. 3 schematically represents a cross-sectional side view of a part of a first version of the breaking device including the breaking member of FIG. 2.

FIG. 3 represents a cross-sectional side view of a part of the breaking device comprising the arcing chamber 16 and the breaking member 26, where the breaking member is close to being in a protruding position. The arcing chamber 16 may be filled with air, gas or other fluid.

The breaking member receiving structure in the arcing chamber 16 comprises an inner cavity 54 for receiving the inner tubular element 28 of the breaking member 26 and an outer cavity 56 for receiving the outer tubular element of the breaking member 26. The cavities 54 and 56 may thus be formed in the body of electrically insulating material, which as was mentioned above may be ceramic or a polymer, like a thermoset or thermoplastic polymer, such as POM, PMMA, PI, PA, PP and/or PMP. Both the cavities may be ring-shaped with a depth corresponding to the protruding length of the corresponding tubular element of the breaking member 26. The inner cavity 54 may more particularly be shaped for receiving the first protruding length of the inner tubular element 28. The inner cavity 54 may thereby have a depth in the direction along the breaking axis 48 that corresponds to the first protruding length of the inner tubular element 28. The bottom of the inner cavity 54 may in this case also be formed by the end section 12. The outer cavity 56 may in turn be shaped for receiving the second protruding length of the outer tubular element 36. The outer cavity 56 may thereby have a depth in the direction along the breaking axis 48 corresponding to the second protruding length of the outer tubular element of the breaking member 26. Through the provision of the inner and outer cavities 54 and 56, there is also formed a wall between them, which wall mates with the recess 46 between the inner and outer tubular elements 28 and 36.

In the arcing chamber 16 there is furthermore at least one vent opening 22, 24A for venting the arcing chamber 16 when arc interruption takes place, where each vent opening leads to a corresponding cavity. As can be seen in the example in FIG. 3, a first group of axial vent openings 22 lead to the bottom of the inner cavity 54. It can also be seen that a first group of radial vent openings 24A also lead to the inner cavity 54 via corresponding vent channels 58A. Each radial vent opening may thereby lead to a cavity via a vent channel. At least one first vent opening in the first group of radial vent openings thus leads to the inner cavity 54.

Each of the axial vent openings 22 and the radial vent openings 24A are constituted by through holes. The axial vent openings 22 extend from the interior of the arcing chamber 16 and through the end section 12. The radial vent openings 24A extend from the interior of the arcing chamber 16 and through the wall 14 via a vent channel 58A. The vent openings 22, 24A are configured to vent the volume within the arcing chamber 16 when the breaking member 26 starts to move from a starting position.

As can also be seen in FIG. 3, the breaking device 10 comprises an electrically conducting outer member 50, an electrically conducting inner member 52 in addition to the breaking member 26, which may all be shaped as tubes or have tubular elements. The breaking device 10 may therefore be referred to as a tubular breaker.

The inner member 52 is arranged radially inside the outer member 50 with respect to the breaking axis 48. The breaking member 26 is arranged radially between the outer member 50 and the inner member 52 with respect to the breaking axis 48.

In this example, each of the outer member 50 and the inner member 52 is an electrically conducting tube concentric with the breaking axis 48. Each of the outer member 50 and the inner member 52 has a circular cross-section. As the elements of the arc interrupting member are also tubular, the breaking device 10 is therefore a triaxial breaking device. One or both of the outer member 50 and the inner member 52 may however adopt shapes other than tubes. The outer member 50 is connected to the outer electrical contact 18 and the inner member 52 is connected to the inner electrical contact 20 (not shown)

As shown in FIG. 3, a space 59 is defined between the outer member 50 and the inner member 52. The space 59 is a space for an initial or starting position of the breaking member 26, where the breaking member rests when the circuit breaker is closed through the outer and inner members 50 and 52 being in electrical contact with each other. The breaking member 26 is then moved from this space 59 into the arcing chamber 16 when moving from the starting position to the protruding position in order to interrupt an arc.

Figure 4:
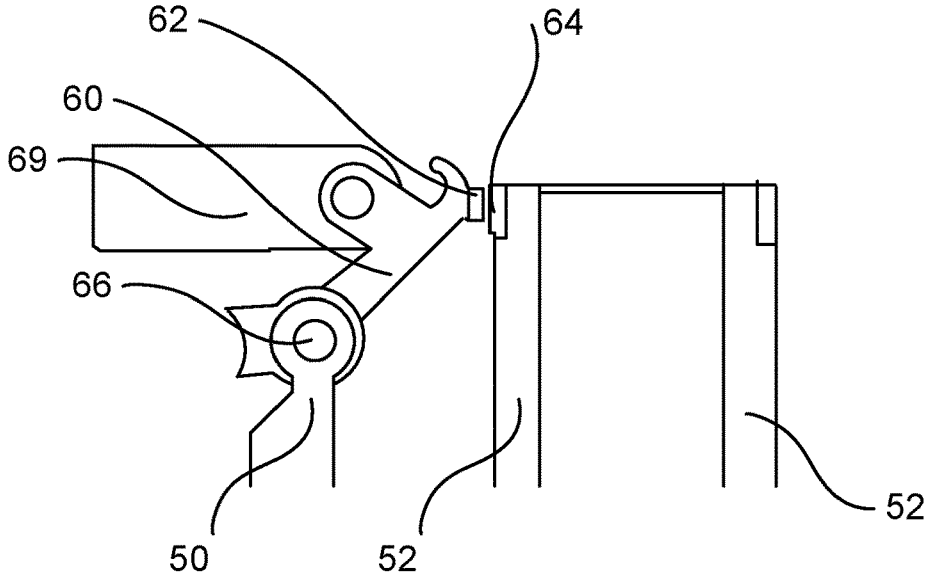
FIG. 4 schematically represents an enlarged partial view of a mechanism used for interconnecting an electrically conducting inner member with an electrically conducting outer member of the breaking device.

As can be seen in FIG. 4, the breaking device 10 further comprises a contact arrangement. The contact arrangement is configured to selectively electrically disconnect the outer member 50 and the inner member 52. The outer member 50 comprises an outer member tip that for this reason is equipped with a tap point 66 and the inner member 52 comprises an inner member tip equipped with a first contact pad 64. There is also a moveable contact element 60 joined to outer member 50 at the tap point 66 and being pivotable around the tap point 66. The moveable contact element 60 comprises a second contact pad 62 and when the breaking member is in the starting position the moveable contact element 60 covers the space 59 and the second contact pad 62 is in contact with the first contact pad 64. If the breaking member is moved to the protruding position, it pushes the moveable contact element 60 upwards and causes the contact element 60 to pivot in a first direction around the tap point 66. This in turn causes the contact pads 62 and 64 to be separated from each other. There is also a closing element 69 connected to the moveable contact element, which closing element 69 can be actuated to cause the contact element 60 to pivot in an opposite second direction around the tap point 66 for connecting the contact pads 62 and 64 to each other.

Each of the outer member tip and the inner member tip are positioned adjacent to the arcing chamber 16.

Figure 5:
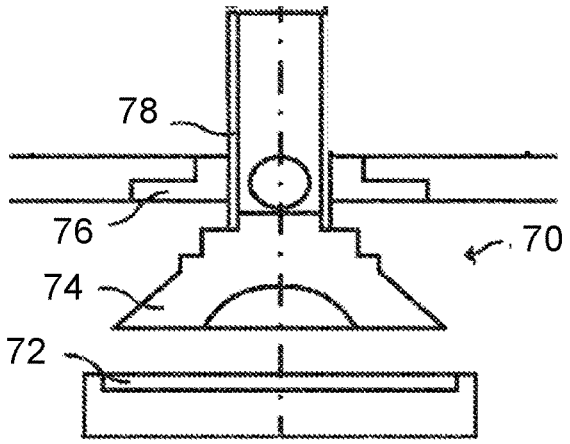
FIG. 5 schematically shows an actuator used for actuating the breaking member.

The breaking device 10 further comprises an actuator. The actuator may be of various types in order to force the breaking member 26 away from the starting position. One example of an actuator is schematically shown in FIG. 5. Here the actuator 70 is exemplified as a ballistic actuator in the form of a Thomson drive. The actuator 70 comprises a Thomson coil 72, an armature 74, an armature relaxing cushion 76, and an actuator tube 78 joined to the breaking member (not shown). The Thomson coil 72 and the armature 74 are arranged to provide energy to a ballistic movement of the breaking member 26.

The operation of the breaking device will now be described with reference being made to FIG. 6A-F, which show movement of the breaking member 26 in a part of the breaking device when interrupting an arc.

In these figures a slightly changed breaking device is used. It can be seen that the outer tubular element 36 of the breaking member is shorter than in the first example shown in FIGS. 2 and 3. In this example the second protruding end is placed closer to the area where the outer tubular element 36 is joined to the inner tubular element 28 than it is to the first protruding end 30, i.e. the second plane with the second protruding end is placed closer to the third plane with the bottom of the recess than to the first plane with the first protruding end 30. The distance between the second plane and the third plane is thus lower than the distance between the second plane and the first plane. Furthermore, it can be seen that in addition to the first group of axial vent openings 22 and the first group of radial vent openings 24A with vent channel 58A there is in this case also a second group of radial vent openings 24B comprising at least one second radial vent opening in the wall of the device leading to the outer cavity 56 via vent channel 58B. The connection between the electrically conducting outer member 50 and the outer electrical contact 18 is also shown.

However, for purposes of overview the actuator as well as the contact arrangement with the moveable contact element have been omitted.

The breaking member 26 is configured to move from the starting position along the breaking axis 48 upwards in FIG. 6A-F in order to reach the protruded position.

The breaking member 26 thereby moves, by means of the actuator 70, from the starting position along the breaking axis 48 to the protruding position where the breaking member 26 protrudes into the arcing chamber 16.

Initially the breaking member 26 is in the starting position in which it is contained in the space 59 between the electrically conducting outer and inner members 50 and 52. Then when a current interruption is desired, the breaking member 26 is moved by the actuator from the starting position along the breaking axis 48. At some point in time the inner tubular element 28 will move the contacting element of the contact arrangement so that it is separated from the conducting inner member 52, thereby creating an arc A between the conducting outer and inner members 50 and 52, see FIG. 6A.

The arc generates an overpressure within the arcing chamber 16. The overpressure is released by means of the vent openings 22, 24A and 24B. Furthermore, venting of the arcing chamber 16 through the vent openings 22, 24A, 24B takes place immediately when the breaking member 26 starts to move.

During the movement of the breaking member 26 from the starting position to the protruding position, the breaking member 26 thus pushes the moveable contact element 60 of the contact arrangement from the electrically connected state into an electrically disconnected state. The outer member 50 is thereby electrically disconnected from the inner member 52 and an arc A is ignited between the outer member 50 and the inner member 52. It should here be realized that the use of the breaking member 26 as a "pushing member" is however only one of several ways to electrically disconnect the outer member 50 and the inner member 52 by means of the contact arrangement.

The inner tubular element 28 of the breaking member 26 will then start to enter the arcing chamber 16 and more particularly start to enter the inner cavity 54 of the arcing chamber 16. This will extend the arc A between the inner and outer members 52 and 50 so that it also passes around the first protruding end 30, see FIG. 6B.

As the breaking member 26 is continued to be moved along the breaking axis, more of the inner tubular element 28 will enter the inner cavity 54. Thereby, the arc will go from the tip of the inner member 52, pass along the inner surface 32 of the inner tubular element 28 around the first protruding end 30 and then back along the outer surface 34 of the inner tubular element 28. If the outer tubular element 36 has not yet entered the arcing chamber the arc will thereafter continue to the tip of the outer member 50, see FIG. 6C. The movement thus further extends or squeezes the arc A.

Figure 6B:
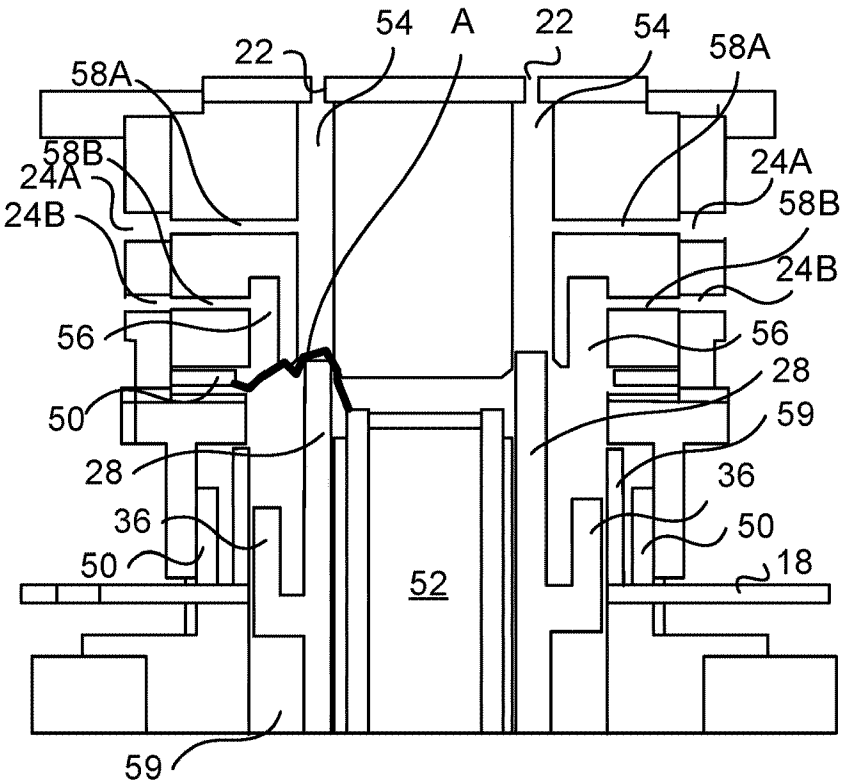
FIG. 6A-F schematically shows cross-sectional side views of a part of a second version of the breaking device in which the breaking member moves from a starting position to a protruding position.
Figure 6A:
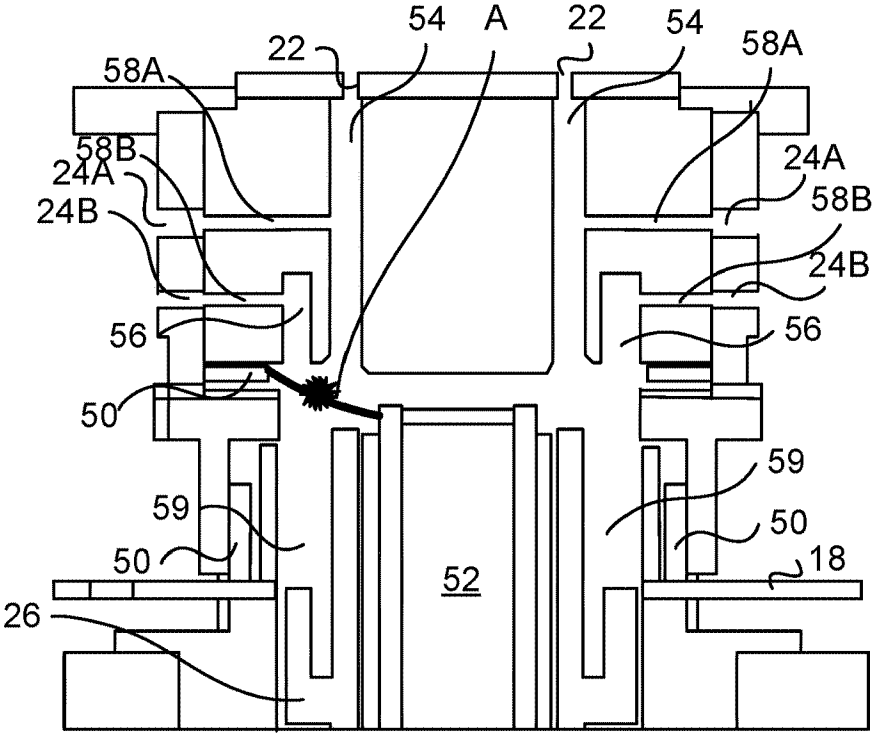
Figure 6D:
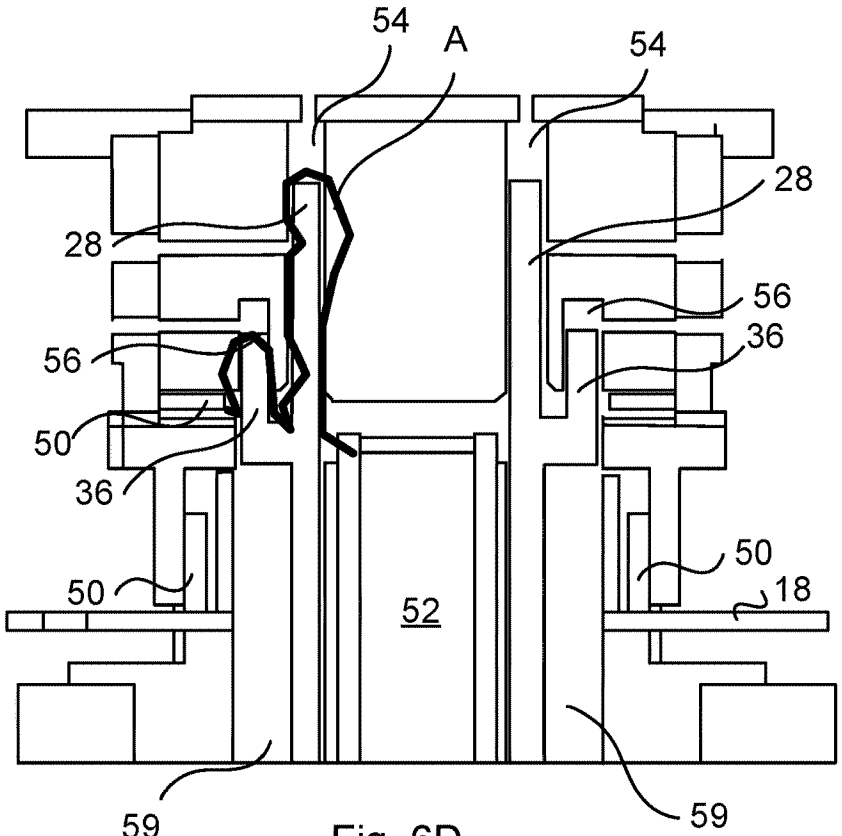
Figure 6C:
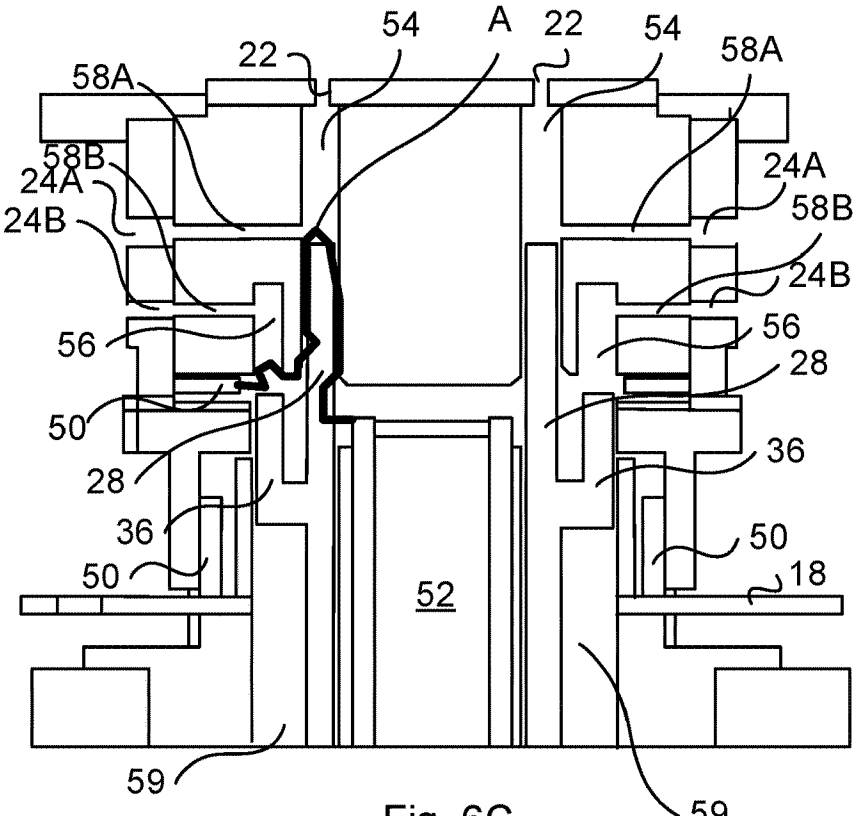

When movement continues along the breaking axis, the outer tubular element 36 then starts to enter the outer cavity 56, which will cause the arc A to go from the tip of the inner member 52, pass by the inner surface 32 of the inner tubular element 28, around the first protruding end 30, back along the outer surface 34 of the inner tubular element 28 into the recess 46 between the inner and outer tubular elements 28 and 36 around the tip of the wall separating the inner and outer cavities 54 and 56, continue along the inner surface 40 of the outer tubular element 36, turn around the second protruding end 38 and then continue along the outer surface 42 of the outer tubular element 36 and make contact with the tip of the outer member 50, see FIG. 6D.

Figure 6F:
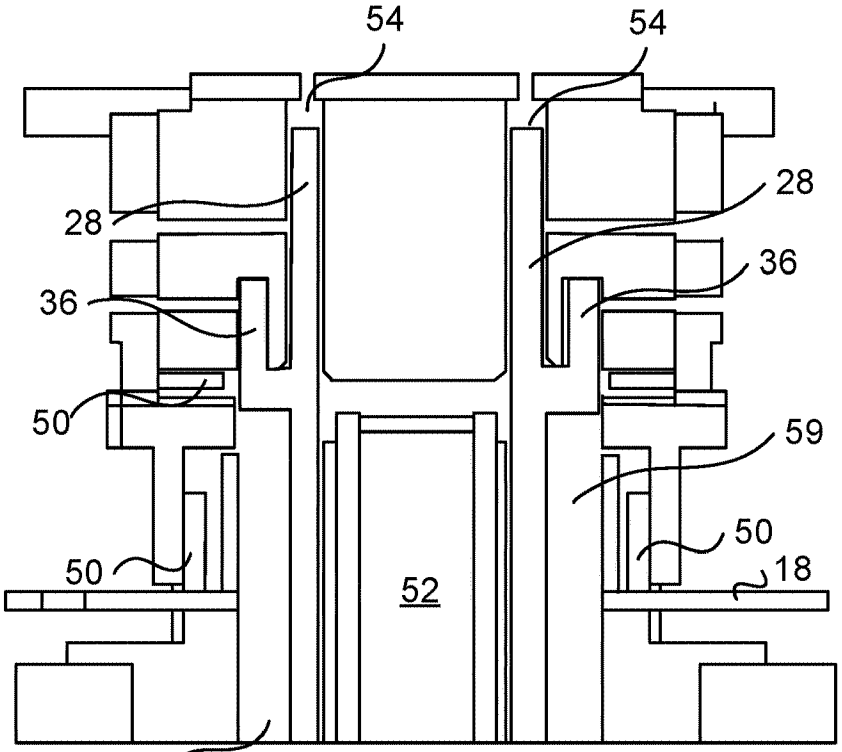
Figure 6E:
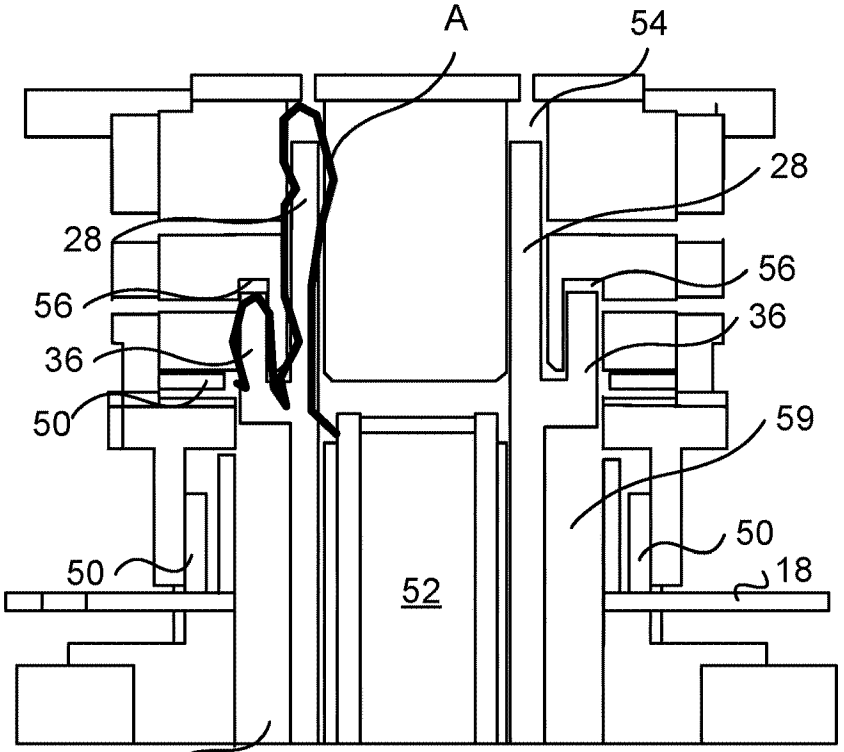

FIG. 6E shows the same path of the arc A when the breaking member is close to reaching the protruding position, i.e. the first protruding end 30 of the inner tubular element 28 is close to the bottom of the inner cavity 54 and the second protruding end 38 of the outer tubular element 36 is close to the bottom of the outer cavity 56.

Finally, the breaking member 26 reaches the protruded position, which is shown in FIG. 6F. In this case the first protruding end 30 has reached and abuts the bottom of the inner cavity 54, the second protruding end 38 has reached and abuts the bottom of the outer cavity 56 and the bottom of the recess 46 between the inner and outer tubular elements 28 and 36 has received and abuts the tip of the wall between the inner and outer cavity 54 and 56 thereby interrupting the arc. The first protruding end 30 of the inner tubular element 28 thus abuts the bottom of the inner cavity 54, the second protruding end 38 of the outer tubular element 36 abuts the bottom of the outer cavity and the bottom of the recess 46 abuts the tip of the wall separating the cavities 54 and 56. Thereby the arc may get chopped and the current quenched. As an alternative it is possible that only one or two of the breaking member parts first protruding end, second protruding end and bottom of the recess actually abuts the corresponding part of the arcing chamber in the protruded position.

The breaking member 26 may then be returned from the protruding position to the starting position for reuse of the breaking device 10. The return movement may for example be made manually or by means of the actuator 70 or the closing element 69 of the contact arrangement.

As is described above and as can be seen in FIG. 6A-F, the arc A is forced to move from the inner member 52, over the first and second protruding ends of the breaking member 26, and back to the outer member 50. The breaking member 26 thereby lengthens the arc path between the outer member 50 and the inner member 52 and forces the arc to pass over this extended length.

That is, the breaking member 26 forces the arc to extend over a considerable distance, which distance corresponds to the sum of twice the first protruding length and twice the second protruding length. In some implementations, this stressing of the arc in the protruding position causes the arc to be extinguished. The protruding position thereby constitutes one position of the breaking member 26 for interrupting a current between the outer member 50 and the inner member 52 by means of the breaking member 26.

The radial vent openings 24 allow for gas to flow out from the arcing chamber 16 from both cavities 54 and 56. The radial vent openings 24A and 24B and the axial vent openings 22 thus allow the arc to move and to avoid excessive pressure inside the arcing chamber 16.

It can thus be seen that a breaking member comprising an inner tubular element and an outer tubular element is inserted between two coaxially arranged electrically conducting members. This tube enters the arcing chamber, where an arc gets elongated and squeezed between the walls of the cavities of the arcing chamber and is finally interrupted.

Through the implementation of the breaking member as an inner and an outer second tubular element, the electric lifetime of the breaking device is improved compared with if only one tubular element is used.

The breaking device 10 has been prototyped and proven to successfully interrupt DC currents in the ranges of 100 V to 10 kV at currents of 5 A to 6 kA. The prototyping also proved that the breaking device 10 can interrupt current multiple times at voltages of up to 2 kV. Furthermore, the prototyping proved that the arcing chamber 16 can be reduced, both in length and diameter, without any significant change of performance.

During nominal current interruption, the inner tubular element firstly enters the arcing chamber and the arc voltage can as an example be built up to approximately 1.2 kV and a nominal current can as an example drop to at least 400 A to 500 A. Then the outer tubular element starts to enter the arcing chamber, and the arc voltage according to the example increase to more than 2 kV together with the inner tubular element. Because current drops much lower than the nominal current (1 kA) at the moment the outer tubular element enters the arcing chamber, arc erosion, i.e. material loss, on the inner tubular element is not severe. What's more, arc erosion on the outer tubular element is also less severe, because entire arcing time gets shorter, compared with if only one tubular element is used. Therefore, the electric lifetime is prolonged.

Furthermore, through using a breaking member with an inner tubular element and an outer tubular element, it may be possible to build up an arc voltage in the arcing chamber that is higher than if only one tubular element is used. It may as an example be in the range 1.2-2.0 times higher depending on the length of the outer tubular element. Alternatively, the erosion of the tubular member is lowered. This can also be achieved with a minimal increase in the size of the breaking device.

The use of the breaking member with an inner tubular element and an outer tubular element thus provides an additional arc length and allows the building of a higher arc voltage, in order to allow a faster interruption of a DC current and to improve electric endurance at nominal current.

The voltage withstand capability of the breaking device 10 mainly depends on the stroke length of the breaking member 26. The current interruption capability mainly depends on the strength of the breaking member 26 to withstand the arc pressure. The length of the stroke, the speed of the breaking member 26, the thickness and length of the breaking member 26 etc. may be varied depending on implementation.

As can be seen above, the protruding length of the outer tubular elements can be varied. The protruding length of the outer tubular element of the breaking member can for instance be extended compared to the previously given examples. As can be seen in an example in FIG. 7, the second protruding end can be located closer to the first protruding end than to the joining area in relation to the breaking axis, i.e. the second plane with the second protruding end may be located closer to the first plane with the first protruding end than to the third plane with the bottom of the recess. Thereby the distance between the second plane and the first plane may be lower than the distance between the second plane and the third plane.

Figure 7:
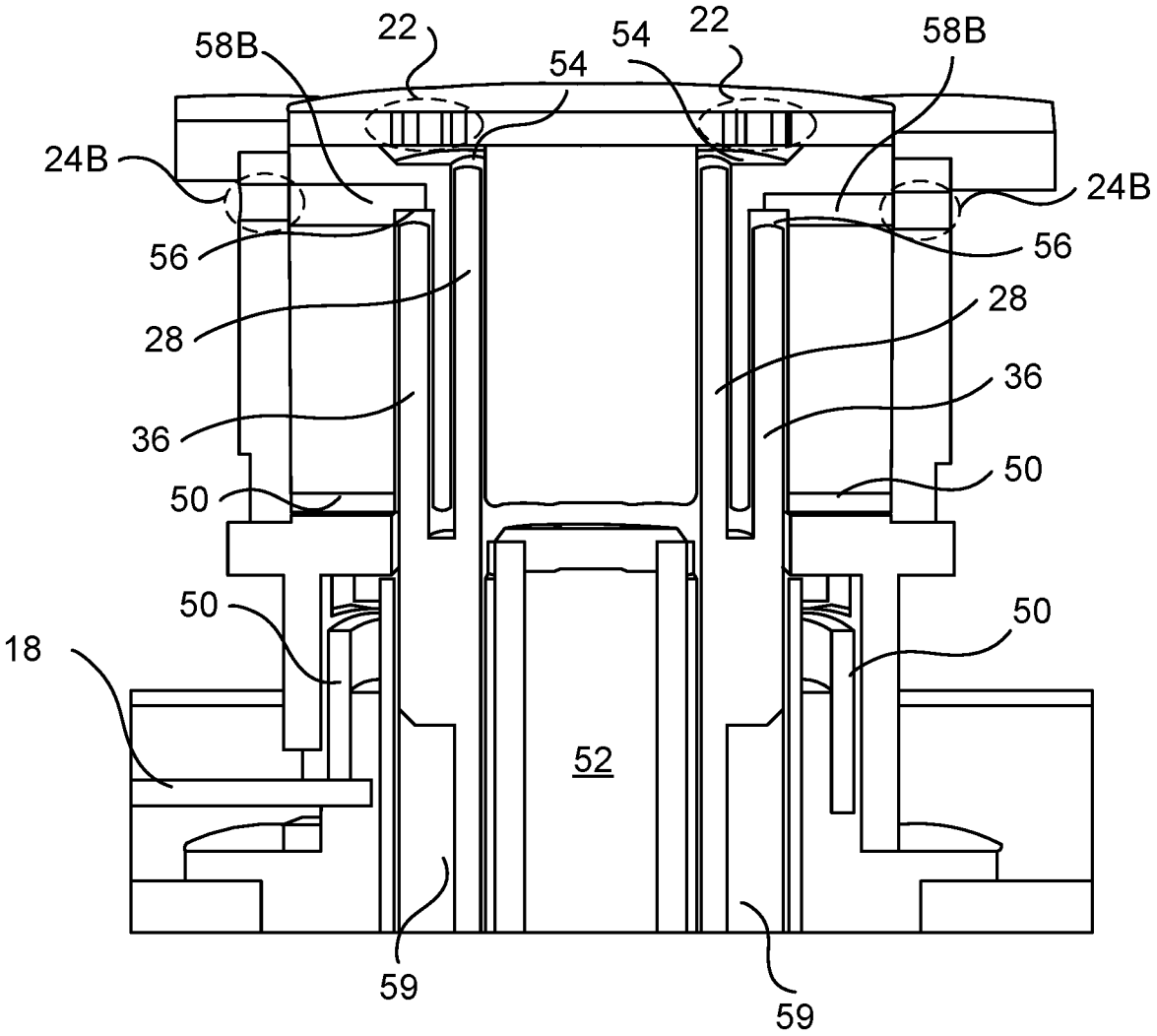
FIG. 7 schematically shows a cross-sectional side view of a part of a third version of the breaking device.

Another difference that can be observed in FIG. 7 is that there is no first group of radial vent openings leading to the inner cavity 54; only the second group of radial vent openings 24B leading to the outer cavity 56 as well as the axial vent openings 22.

While the present disclosure has been described with reference to exemplary embodiments, it will be appreciated that the present invention is not limited to what has been described above. For example, it will be appreciated that the dimensions of the parts may be varied as needed.

The invention claimed is:

1. A breaking device for interrupting current, the breaking device comprising:

an electrically conducting outer member;

an electrically conducting inner member arranged radially inside the outer member with respect to a breaking axis; and an electrically insulating or semiconducting breaking member arranged radially between the outer member and the inner member with respect to the breaking axis, the breaking member being arranged to move along the breaking axis from a starting position to a protruding position in which the breaking member protrudes from a space within the outer member for interrupting a current between the outer member and the inner member;

the breaking member comprising an inner tubular element and an outer tubular element, where the outer tubular element is joined to an outer surface of the inner tubular element thereby defining a recess between the outer tubular element and the inner tubular element.

2. The breaking device according to claim 1, wherein the outer tubular element is joined to the inner tubular element at a joining area of the outer surface of the inner tubular element, the inner tubular element comprises a first protruding end and the outer tubular element includes a second protruding end, where the second protruding end is located between the first protruding end and the joining area in relation to the breaking axis.

3. The breaking device according to claim 2, wherein the second protruding end is substantially located midway between the joining area and the first protruding end in relation to the breaking axis.

4. The breaking device according to claim 2, wherein the second protruding end is located closer to the joining area than to the first protruding end in relation to the breaking axis.

5. The breaking device according to claim 2, wherein the second protruding end is located closer to the first protruding end than to the joining area in relation to the breaking axis.

6. The breaking device according to claim 2, further comprising an arcing chamber including an inner cavity for receiving the inner tubular element and an outer cavity for receiving the outer tubular element.

7. The breaking device according to claim 1, further comprising an arcing chamber including an inner cavity for receiving the inner tubular element and an outer cavity for receiving the outer tubular element.

8. The breaking device according to claim 7, wherein the outer tubular element is joined to the inner tubular element at a joining area of the outer surface of the inner tubular element, the inner tubular element comprises a first protruding end and the outer tubular element includes a second protruding end, where the second protruding end is located between the first protruding end and the joining area in relation to the breaking axis, and wherein in the protruding position, the first protruding end of the inner tubular element is arranged to abut a bottom of the inner cavity, the second protruding end of the outer tubular element is arranged to abut a bottom of the outer cavity and/or a bottom of the recess is arranged to abut a tip of a wall of the arcing chamber separating the inner cavity from the outer cavity.

9. The breaking device according to claim 8, further comprising at least one vent opening for venting the arcing chamber when the breaking member has moved from the starting position, where each vent opening leads to one of the inner cavity and the outer cavity.

10. The breaking device according to claim 7, further comprising at least one vent opening for venting the arcing chamber when the breaking member has moved from the starting position, where each vent opening leads to one of the inner cavity and the outer cavity.

11. The breaking device according to claim 10, wherein at least one first radial vent opening leads to the inner cavity.

12. The breaking device according to claim 11, wherein each radial vent opening leads to a cavity via a vent channel.

13. The breaking device according to claim 12, wherein the outer member and/or the inner member is an electrically conducting tube.

14. The breaking device according to claim 12, wherein the outer member, the inner member, the inner tubular element and the outer tubular element are substantially concentric with the breaking axis.

15. The breaking device according to claim 11, wherein at least one second radial vent opening leads to the outer cavity.

16. The breaking device according to claim 10, wherein at least one second radial vent opening leads to the outer cavity.

17. The breaking device according to claim 1, further comprising an actuator arranged to force the breaking member from the starting position to the protruding position.

18. The breaking device according to claim 1, further comprising a contact arrangement including a moveable contact element configured to selectively electrically disconnect the outer member and the inner member.

* * * * *